US010793936B2

(12) United States Patent
Kim et al.

(10) Patent No.: US 10,793,936 B2
(45) Date of Patent: Oct. 6, 2020

(54) HIGH STRENGTH GALVANIZED STEEL SHEET HAVING EXCELLENT SURFACE QUALITIES, PLATING ADHESION, AND FORMABILITY, AND METHOD FOR MANUFACTURING SAME

(71) Applicant: POSCO, Pohang-si, Gyeongsangbuk-do (KR)

(72) Inventors: Myung-Soo Kim, Gwangyang-si (KR); Ki-Cheol Kang, Gwangyang-si (KR); Jong-Ho Kim, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 186 days.

(21) Appl. No.: 15/539,669

(22) PCT Filed: Dec. 23, 2015

(86) PCT No.: PCT/KR2015/014167
§ 371 (c)(1),
(2) Date: Jun. 23, 2017

(87) PCT Pub. No.: WO2016/105115
PCT Pub. Date: Jun. 30, 2016

(65) Prior Publication Data

US 2018/0002790 A1 Jan. 4, 2018

(30) Foreign Application Priority Data

Dec. 23, 2014 (KR) ..... 10-2014-0187622

(51) Int. Cl.

| | |
|---|---|
| ***C22C 38/58*** | (2006.01) |
| ***C21D 8/02*** | (2006.01) |
| ***C23C 2/06*** | (2006.01) |
| ***C22C 38/44*** | (2006.01) |
| ***C22C 38/04*** | (2006.01) |
| ***C22C 38/60*** | (2006.01) |
| ***C22C 38/00*** | (2006.01) |
| ***C22C 38/48*** | (2006.01) |
| ***C22C 38/54*** | (2006.01) |
| ***C21D 8/04*** | (2006.01) |
| ***C23C 2/02*** | (2006.01) |
| ***C23C 2/40*** | (2006.01) |
| ***C21D 9/46*** | (2006.01) |
| ***C22C 38/02*** | (2006.01) |
| ***C22C 38/06*** | (2006.01) |
| ***C22C 38/50*** | (2006.01) |

(52) U.S. Cl.

CPC ..... *C22C 38/58* (2013.01); *C21D 8/02* (2013.01); *C21D 8/0205* (2013.01); *C21D 8/0226* (2013.01); *C21D 8/0273* (2013.01); *C21D 8/0473* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C22C 38/54* (2013.01); *C22C 38/60* (2013.01); *C23C 2/02* (2013.01); *C23C 2/06* (2013.01); *C23C 2/40* (2013.01); *C21D 8/0236* (2013.01); *C21D 2211/001* (2013.01)

(58) Field of Classification Search
None
See application file for complete search history.

(56) References Cited

U.S. PATENT DOCUMENTS

| | | | | |
|---|---|---|---|---|
| 6,517,955 | B1 * | 2/2003 | Takada | C21D 8/0278 148/522 |
| 2002/0160221 | A1 | 10/2002 | Takeda et al. | |
| 2003/0054195 | A1 * | 3/2003 | Ishii | C21D 8/0278 428/653 |
| 2004/0055667 | A1 * | 3/2004 | Takada | C21D 8/0278 148/533 |
| 2006/0037677 | A1 * | 2/2006 | Ono | C21D 8/0426 148/603 |
| 2006/0292391 | A1 | 12/2006 | Ikematsu et al. | |
| 2007/0190353 | A1 | 8/2007 | Taniguchi et al. | |

(Continued)

FOREIGN PATENT DOCUMENTS

| | | | |
|---|---|---|---|
| CN | 1930316 | A | 3/2007 |
| CN | 101657557 | A | 2/2010 |

(Continued)

OTHER PUBLICATIONS

International Search Report dated May 4, 2016, issued in International Application No. PCT/KR2015/014167. (w/ partial English translation).

(Continued)

*Primary Examiner* — Adam Krupicka
(74) *Attorney, Agent, or Firm* — Morgan, Lewis & Bockius LLP

(57) ABSTRACT

A high strength galvanized steel sheet having excellent surface qualities, plating adhesion, and formability is provided, wherein a galvanized layer is formed on a cold-rolled steel sheet comprising 0.1-0.3 wt % of C, 1-2.5 wt % of Si, 2.5-8 wt % of Mn, 0.001-0.5 wt % of sol. Al, at most 0.04 wt % of P, at most 0.015 wt % of S, at most 0.02 wt % of N (excluding 0 wt %), 0.1-0.7 wt % of Cr, at most 0.1 wt % of Mo, (48/14)*[N] to 0.1 wt % of Ti, 0.005-0.5 wt % of Ni, 0.01-0.07 wt % of Sb, at most 0.1 wt % of Nb, and at most 0.005 wt % of B, with the remainder being Fe and other inevitable impurities.

6 Claims, No Drawings

(56) References Cited

U.S. PATENT DOCUMENTS

| | | | | |
|---|---|---|---|---|
| 2008/0295928 | A1* | 12/2008 | Kim | C21D 8/0236 148/651 |
| 2010/0104890 | A1 | 4/2010 | Satoh et al. | |
| 2011/0017363 | A1 | 1/2011 | Kang et al. | |
| 2011/0030857 | A1 | 2/2011 | Kwak et al. | |
| 2011/0083774 | A1 | 4/2011 | Jin et al. | |
| 2011/0139315 | A1* | 6/2011 | Nakagaito | C21D 1/25 148/533 |
| 2011/0252849 | A1 | 10/2011 | Park et al. | |
| 2013/0061989 | A1* | 3/2013 | Nakamura | C21D 8/0226 148/602 |
| 2014/0234658 | A1* | 8/2014 | Nozaki | C23C 2/06 428/659 |
| 2016/0002762 | A1 | 1/2016 | Fushiwaki et al. | |

FOREIGN PATENT DOCUMENTS

| | | | |
|---|---|---|---|
| CN | 101910439 | A | 12/2010 |
| CN | 101910441 | A | 12/2010 |
| EP | 2143816 | A1 | 1/2010 |
| JP | 2002-322551 | A | 11/2002 |
| JP | 2005-256089 | A | 9/2005 |
| JP | 2011-153368 | A | 8/2011 |
| JP | 2011-241430 | A | 12/2011 |
| KR | 10-2009-0006881 | | 1/2009 |
| KR | 10-2009-0120759 | A | 11/2009 |
| KR | 10-2010-0030627 | A | 3/2010 |
| KR | 10-2014-0081622 | A | 7/2014 |
| WO | 2009004426 | A1 | 1/2009 |
| WO | 2009142362 | A1 | 11/2009 |
| WO | 2014/136412 | A1 | 9/2014 |

OTHER PUBLICATIONS

Extended European Search Report for Application No. 15873642.1 dated Nov. 7, 2017.

Chinese Office Action dated Mar. 19, 2018 issued in Chinese Patent Application No. 201580070546.7.

* cited by examiner

HIGH STRENGTH GALVANIZED STEEL SHEET HAVING EXCELLENT SURFACE QUALITIES, PLATING ADHESION, AND FORMABILITY, AND METHOD FOR MANUFACTURING SAME

CROSS-REFERENCE TO RELATED APPLICATIONS

This application is the U.S. National Phase of PCT/KR2015/014167 filed Dec. 23, 2015, which claims priority to Korean Patent Application No. 10-2014-0187622 filed Dec. 23, 2014. The subject matter of each is incorporated herein by reference in entirety.

TECHNICAL FIELD

The present disclosure relates to a high strength galvanized steel sheet able to be used in forming a member for an automotive body structure or the like and, more particularly, to a high strength galvanized steel sheet having excellent surface qualities, plating adhesion, and formability, while having a tensile strength of 1,000 MPa or higher, and a method for manufacturing the same.

BACKGROUND ART

In recent years, there has been continuing demand for the lightening of automobiles, due to the regulation of carbon dioxide emissions for global environmental preservation, and for the provision of high strength in automotive steel sheets in order to improve the collision stability of automobiles. In order to satisfy such demand, high strength steel sheets having a tensile strength of 1,000 MPa or higher have recently been developed and applied to automobiles. A high strength steel sheet may be readily manufactured using a method for increasing the strength of a steel sheet, for example, a method for increasing the amount of added reinforcing components of steel including carbon (C). However, since cracking should not occur in the process of forming steel sheets for automotive bodies as automotive bodies, the elongation percentage of the steel sheets may also be secured.

Mn, Si, Al, Cr, and Ti may be used as components mainly added to steel to simultaneously ensure the strength and ductility of steel sheets for automobiles. Steel sheets having high levels of strength and ductility may be manufactured by properly adjusting the amounts of added components and controlling manufacturing process conditions. However, components, such as Si, Mn, or Al, added to obtain high strength steel sheets for automobiles having a tensile strength of 1,000 MPa or higher, may be easily oxidized. Therefore, high strength steel sheets containing Si, Mn, or Al may react with a trace of oxygen or water vapor existing in an annealing furnace to form single or complex oxides of Si, Mn, or Al. Such oxides hinder wettability with respect to zinc, such that so-called "bare spots," in which the surface of plated steel sheets is locally or entirely uncoated with zinc, may occur. Thus, the surface qualities of plated steel sheets may be significantly deteriorated. Further, in the case that oxide is present on the surface of the steel sheet after annealing, when the steel sheet is dipped in a galvanizing bath, a Fe—Al alloy phase, obtained through a reaction between Al and the Fe of the steel sheet, is not formed, resulting in a so-called "plating delamination phenomenon" in which poor adhesion between the galvanized layer and the base steel may cause the galvanized layer to be delaminated in the process of forming the steel sheet. The formation of the single or complex oxides of Si, Mn, or Al as described above may be exacerbated as the content of oxidative components such as Si, Mn, or Al increases. Thus, bare spots and plating delamination may appear more intense in the case of high strength steel sheets having a tensile strength of 1,000 MPa or higher.

To address the above issues, a variety of solutions have been presented. Patent Document 1 provides a galvanized steel sheet, in which a steel sheet is oxidized in a direct flame furnace, having an oxidative atmosphere, through controlling an air-fuel ratio to be in a range of 0.80 to 0.95 in an annealing process to form iron (Fe) oxide including single or complex oxides such as Si, Mn, or Al to a predetermined depth in the steel sheet, the Fe oxide is reduced by reduction annealing in a reducing atmosphere, and hot-dip galvanizing is then performed. When the method for reduction after oxidation is used in the annealing process as described above, the diffusion of the easily oxidizable components, such as Si, Mn, or Al, to the surface layer of the steel sheet is inhibited by the oxides formed at a predetermined depth from the surface layer of the steel sheet to relatively reduce the single or complex oxides of Si, Mn, or Al in the surface layer, and thus bare spots may be reduced by the improvement of wettability with respect to zinc in a galvanizing bath. However, since an internal oxide layer, composed of Si, Mn, and/or Al, present below an iron oxide layer generated in the oxidation process is present and is not reduced in a subsequent reduction process, the internal oxide layer is present in the base steel (reduced Fe layer) or the base steel directly under the interface between the base steel and the galvanized layer in the form of an oxide layer in a direction parallel to the surface of the steel sheet after the completion of the plating process. Thus, adhesion may significantly decrease in the portion of the oxide layer between the reduction layer and the base steel during press working of the steel sheet.

Further, Patent Document 2 provides a galvanized steel sheet having improved plating adhesion, in which preplating of Fe on a steel sheet at a coating weight of 10 g/m$^2$ before annealing is performed in order to inhibit the diffusion of Si and Mn into the surface thereof during an annealing process and reduction annealing is then performed, Si and Mn of a base steel diffuse into the Fe preplated layer, but not into the surface thereof due to the formation of oxides in the thick preplated layer, and thus the surface has excellent platability due to the absence of oxides and Si and Mn oxides are also discontinuously dispersed in the preplated layer, so that plating adhesion may be increased. However, when the reduction annealing is performed after the formation of the thick Fe preplated layer as described above, Si and Mn present in the base steel under the preplated layer may not diffuse into the surface thereof. However, the coating weight must be increased to an amount of 10 g/m$^2$ or more in order to inhibit the diffusion of oxidative components, such as Si or Mn, into the surface thereof during the reduction annealing, and thus electroplating equipment for forming a thick Fe preplated layer may be increased in size, thereby entailing an increase in costs.

As another method, Patent Document 3 provides a method for maintaining a high dew point within an annealing furnace to oxidize easily oxidizable components, such as Mn, Si, or Al, in steel so as to reduce oxides oxidized externally of the surface of a steel sheet after annealing, thereby increasing platability. When oxidative components are internally oxidized using the above methods, platability may be increased through a reduction in external oxidation thereof. However, when stress is applied to a steel sheet during press forming thereof, an internal oxide present in a surface layer portion of the steel sheet is vulnerable to external stress, in that the internal oxide may be likely to be destroyed. Thus, the steel sheet may be prone to cracking.

RELATED ART DOCUMENTS

Patent Document 1: Korean Patent Application Laid-Open Publication No. 2010-0030627
Patent Document 2: Japanese Patent Application Laid-Open Publication No. 2002-322551
Patent Document 3: Korean Patent Application Laid-Open Publication No. 2009-0006881

DISCLOSURE

Technical Problem

An aspect of the present disclosure may provide a high strength galvanized steel sheet having excellent surface qualities, plating adhesion, and formability, while having a tensile strength of 1,000 MPa or higher.

Another aspect of the present disclosure may provide a method for manufacturing a high strength galvanized steel sheet having excellent surface qualities, plating adhesion, and formability, while having a tensile strength of 1,000 MPa or higher.

Technical Solution

According to an aspect of the present disclosure, a high strength galvanized steel sheet having excellent surface qualities, plating adhesion, and formability may be provided, in which a galvanized layer may be formed on a cold-rolled steel sheet comprising 0.1-0.3 wt % of C, 1-2.5 wt % of Si, 2.5-8 wt % of Mn, 0.001-0.5 wt % of sol. Al, 0.04 wt % or less of P, 0.015 wt % or less of S, 0.02 wt % or less of N (excluding 0 wt %), 0.1-0.7 wt % of Cr, 0.1 wt % or less of Mo, (48/14)*[N] to 0.1 wt % of Ti, 0.005-0.5 wt % of Ni, 0.01-0.07 wt % of Sb, 0.1 wt % or less of Nb, and 0.005 wt % or less of B, with the remainder being Fe and other inevitable impurities, and the average content of Sb in the galvanized layer from the surface of the cold-rolled steel sheet to a depth of 0.1 μm may be at least 1.5 times that at a depth of at least 0.5 μm or more from the surface of the cold-rolled steel sheet.

According to another aspect of the present disclosure, a method for a high strength galvanized steel sheet having excellent surface qualities, plating adhesion, and formability may include: forming a steel slab comprising 0.1-0.3 wt % of C, 1-2.5 wt % of Si, 2.5-8 wt % of Mn, 0.001-0.5 wt % of sol. Al, 0.04 wt % or less of P, 0.015 wt % or less of S, 0.02 wt % or less of N (excluding 0 wt %), 0.1-0.7 wt % of Cr, 0.1 wt % or less of Mo, (48/14)*[N] to 0.1 wt % of Ti, 0.005-0.5 wt % of Ni, 0.01-0.07 wt % of Sb, 0.1 wt % or less of Nb, and 0.005 wt % or less of B, with the remainder being Fe and other inevitable impurities; reheating the steel slab at a temperature of 1100-1300° C.; ultimately hot rolling the re-heated steel slab at a $Ar_3$ transformation point or higher; coiling the hot rolled steel sheet at a temperature of 700° C. or lower; pickling and then cold rolling the coiled steel sheet; recrystallization annealing the cold rolled steel sheet at a dew point temperature of −60° C. to −20° C. and at a temperature of 750-950° C. for 5 to 120 seconds; cooling the annealed cold-rolled steel sheet to 200-600° C. at an average cooling rate of 2-150° C./s; reheating or cooling the cooled steel sheet to a temperature of (galvanizing bath temperature−20° C.) to (galvanizing bath temperature+100° C.); and plating the reheated or cooled steel sheet by dipping in a galvanizing bath maintained at a temperature of 450-500° C.

Advantageous Effects

According to an embodiment in the present disclosure, a high strength galvanized steel sheet, able to be used in a member for an automotive body structure or the like, having excellent surface qualities, plating adhesion, and formability, while having a tensile strength of 1,000 MPa or higher, may be provided by manufacturing a galvanized steel sheet according to the present disclosure.

BEST MODE FOR INVENTION

The present disclosure relates to a high strength galvanized steel sheet having excellent surface qualities, plating adhesion, and formability, while having a tensile strength of 1,000 MPa or higher, and a method for manufacturing the same.

Hereinafter, the high strength galvanized steel sheet having excellent surface qualities, plating adhesion, and formability, according to the present disclosure, will be described in detail.

The high strength galvanized steel sheet having excellent surface qualities, plating adhesion, and formability, according to the present disclosure, may be provided, in which a galvanized layer is formed on a cold-rolled steel sheet comprising 0.1-0.3 wt % of C, 1-2.5 wt % of Si, 2.5-8 wt % of Mn, 0.001-0.5 wt % of sol. Al, 0.04 wt % or less of P, 0.015 wt % or less of S, 0.02 wt % or less of N (excluding 0 wt %), 0.1-0.7 wt % of Cr, 0.1 wt % or less of Mo, (48/14)*[N] to 0.1 wt % of Ti, 0.005-0.5 wt % of Ni, 0.01-0.07 wt % of Sb, 0.1 wt % or less of Nb, and 0.005 or less wt % of B, with the remainder being Fe and other inevitable impurities, and the average content of Sb in the galvanized layer from the surface of the cold-rolled steel sheet to a depth of 0.1 μm may be at least 1.5 times that at a depth of 0.5 μm or more from the surface of the cold-rolled steel sheet.

Hereinafter, the reasons for limiting the compositions of the steel will be described in detail (the following compositions denote weight % unless otherwise specified).

Carbon (C): 0.05-0.3 wt %

C may be required to be added in an amount of 0.1 wt % or more, since C is necessary to ensure the strength of martensite. However, when the content of C exceeds 0.3 wt %, ductility, bendability, and weldability may decrease to degrade press formability and roll processability. Thus, the content of C may preferably be 0.1-0.3 wt %.

Silicon (Si): 1-2.5 wt %

Si may stabilize ferrite and residual austenite at room temperature while increasing the yield strength of steel, and thus may preferably be contained in an amount of 1 wt % or more. Further, Si may inhibit the precipitation of cementite and may significantly hinder the growth a carbide when cooled from austenite to contribute to stabilizing a sufficient amount of residual austenite in the case of transformation induced plasticity (TRIP) steel. Thus, as in the present disclosure, Si may be required to obtain a value of tensile strength (MPa)×elongation (%) of 15,000 or greater, while achieving a tensile strength of 1,000 MPa or higher. In contrast, when Si is added in an excessive amount, hot rolling load may increase to cause hot rolling cracking. In addition, even when other components and manufacturing methods meet the range of the present disclosure, an amount of concentrated Si on the surface of steel may increase after annealing, to degrade platability. Thus, the content of Si may preferably be restricted to 2.5 wt % or less.

Manganese (Mn): 2.5-8 wt %

The content of Mn may preferably be 2.5-8 wt %. Mn is well known as a hardenability increasing element inhibiting formation of ferrite and stabilizing austenite in steel. In order to secure 1,000 MPa or higher of a tensile strength in a steel sheet, 2.5 wt % or more of Mn may be required. As the content of Mn increases, strength may be easily ensured. However, an increase in the surface oxidation amount of Mn in an annealing process may make it difficult to secure platability even using the manufacturing method according to the present disclosure. Thus, the content of Mn may preferably be restricted to 8 wt % or less.

Aluminum (Al): 0.001-0.5 wt %

Al may be an element added for deoxidation in a steel manufacturing process, and may be a carbonitride formation element. Al may be an alloying element expanding a ferrite region, and may reduce annealing costs by lowering a Ac1 transformation point. Thus, Al may be required to be added in an amount of 0.001 wt % or more. When the content of Al exceeds 1 wt %, an increase in the surface oxidation amount of Al in an annealing process, with weldability deteriorating, may make it difficult to ensure platability, even when using the manufacturing method according to the present disclosure. Thus, the content of sol.Al may preferably be 0.001-0.5 wt %.

Phosphorus (P): 0.04 wt % or Less

P may be an impurity element. When the content of P exceeds 0.04 wt %, the risk of the occurrence of degradation of weldability and brittleness of steel may be great and dent defects may be highly likely to occur. Thus, the upper limit of the content of P may preferably be restricted to 0.04 wt %.

Sulfur (S): 0.015 wt % or Less

Similar to P, S may be an impurity element and may be an element degrading ductility and weldability of a steel sheet.

When the content of S exceeds 0.015 wt %, S may be highly likely to degrade the ductility and weldability of the steel sheet. Thus, the upper limit of the content of S may preferably be restricted to 0.015 wt %.

Nitrogen (N): 0.02 wt % or Less

When the content of N exceeds 0.02 wt %, the risk of the occurrence of cracking may be significantly increased during continuous casting due to AlN formation. Thus, the upper limit of the content of N may preferably be restricted to 0.02 wt %.

Chromium (Cr): 0.1-0.7 wt %

Cr may be a hardenability increasing element and may inhibit the formation of ferrite. In order to secure 5-25 wt % of residual austenite, Cr may preferably be added in an amount of 0.1 wt % or more. When the content of Cr exceeds 0.7 wt %, the cost of alloy iron may be increased due to an excessive amount of added alloy. Thus, the content of Cr may preferably be 0.1-0.7 wt %.

Molybdenum (Mo): 0.1 wt % or Less

Mo may be selectively added. The content of Mo may preferably be 0.1 wt % or less, more preferably 0.001-0.1 wt %. Mo may have a significant effect of contributing to an increase in strength, similarly to Cr. However, Mo may be a relatively expensive component and, when the content of Mo exceeds 0.1 wt %, Mo may be economically undesirable.

Titanium (Ti): (48/14)*[N] to 0.1 wt %

Ti as a nitride forming element may have the effect of reducing the concentration of N in steel. For this purpose, Ti may be required to be added in a chemically equivalent amount of (48/14)*[N] wt % or more. When Ti is not added, hot rolling cracking may occur due to AlN formation. When the content of Ti exceeds 0.1 wt %, the C concentration and strength of martensite may be reduced due to additional precipitation of carbide, in addition to removal of dissolved N. Thus, the content of Ti may preferably be (48/14)*[N] to 0.1 wt %.

Nickel (Ni): 0.005-0.5 wt %

Since Ni is not nearly concentrated on the surface of steel in an annealing process so as not to degrade platability, Ni may be added in an amount of 0.005 wt % or more in order to increase strength. When the content of Ni exceeds 0.5 wt %, pickling of a hot-rolled steel sheet may be non-uniform. Thus, the content of Ni may preferably be 0.005-0.5 wt %.

Antimony (Sb): 0.01-0.07 wt %

Sb may be an important component necessarily added to ensure surface qualities and adhesion. As described above, a large amount of Si, Al, or Mn may be added to manufacture a steel sheet having high levels of strength and elongation. When such a steel sheet is subjected to reduction and recrystallization annealing, Si, Al, or Mn in steel may be diffused into the surface thereof to form a large amount of a complex oxide on the surface. In this case, most of the annealed surface may be covered by the oxide to significantly degrade wettability with respect to Zn when the steel sheet is dipped in a. galvanizing bath, and thus so-called "bare spots" to which Zn is not attached may occur. In addition, even when the steel sheet is galvanized, a Fe—Al alloy phase may not be formed at an interface between the steel sheet and a galvanized layer to degrade adhesion between the galvanized layer and a base steel, and thus plating delamination may occur.

However, when Sb is added to steel in an amount of 0.01-0.07 wt % to maintain a dew point within an annealing furnace at −60° C. to −20° C. and to perform reduction annealing, Sb may be concentrated within a depth of 0.2 μm in a depth direction from a surface layer portion of the steel sheet or from the base steel to relatively inhibit the surface diffusion of Si, Mn, or Al, thus reducing the concentration amount of a surface oxide consisting of Si, Mn, and Al. In this case, since wettability with respect to Zn is good in a portion in which oxide is not present, overall platability may be increased. Further, since the Fe—Al alloy phase is formed at the interface between the galvanized layer and the base steel through a reaction between Fe in steel and Al in the galvanizing bath in the portion in which the oxide is not present after annealing, plating adhesion may be increased. However, in the case that the dew point is lower than −60° C., Mn may be partially reduced at the dew point so that a surface diffusion rate of Si or Al may be increased instead of a decrease in a surface diffusion rate of Mn. Thus, the surface oxide may be formed of an oxide including Al or Si as a dominant component. Since the surface oxide including Al or Si as a dominant component significantly degrades wettability with respect to Zn compared to a surface oxide including Mn as a dominant component, even when Sb is added, a platability increasing effect may be reduced.

Sb may preferably be added in an amount of 0.01-0.07 wt %. When the amount of added Sb is less than 0.01 wt %, the effect of inhibiting of the surface concentration of Si, Mn, or Al may be poor and, when the amount of added Sb exceeds 0.07 wt %, brittleness of the steel sheet may be increased to reduce elongation. Thus, Sb may preferably be added in an amount of 0.01-0.07 wt %.

Niobium (Nb): 0.1 wt % or Less

Nb may be selectively added. Nb may segregate into austenite grain boundaries in the form of a carbide to inhibit coarsening of austenite grains during annealing so as to increase strength and, in the case that the content of Nb exceeds 0.1 wt %, the cost of alloy iron may be increased due to an excessive amount of added alloy. Thus, the content of Nb may preferably be 0.1 wt % or less.

Boron (B): 0.005 wt % or Less

B may be selectively added to ensure strength. When the content of B exceeds 0.005 wt %, B may be concentrated on an annealing surface to significantly degrade platability. Thus, the content of B may preferably be 0.005 wt % or less.

In the present disclosure, the remainder thereof may be Fe. However, in a common steel manufacturing process, unintended impurities may be inevitably incorporated from raw materials or steel manufacturing environments, so that they may not be excluded. These impurities may be well known to those skilled in the art and, for example, impurities that may be generated by adding a predetermined amount of Fe scraps, such as Cu, Mg, Zn, Co, Ca, Na, V, Ga, Ge, As, Se, In, Ag, W, Pb, or Cd, may be contained in an amount of less than 0.1 wt %, respectively. However, this may not lower the effects of the present disclosure.

The high strength galvanized steel sheet of the present disclosure may be formed by stacking the galvanized layer on the cold-rolled steel sheet by galvanizing, and the average content of Sb in the galvanized layer from the surface of the cold-rolled steel sheet to a depth of 0.1 μm may preferably be 1.5 times that at a depth of 0.5 μm or more from the surface of the cold-rolled steel sheet. The concentration of Sb on the surface layer portion of the cold-rolled steel sheet may have the effect of inhibiting the surface diffusion of Si, Mn, or Al. As the extent of the concentration of Sb is high, the effect of inhibiting the surface diffusion of Si, Mn, or Al may be great. In order to ensure plating surface qualities and plating adhesion, the average content of Sb at least to a depth of 0.1 μm in a thickness direction of the steel sheet from the surface of the cold-rolled steel sheet may preferably be concentrated to exceed 1.5 times the average content of Sb at a depth of 0.5 μm or more in the thickness direction of the steel sheet from the interface of the cold-rolled steel sheet.

Microstructures of the high strength galvanized steel sheet of the present disclosure may include ferrite, bainite, martensite, and austenite. In particular, residual austenite may have an area fraction of 5-25%, and thus a tensile strength of 900 MPa or higher and a value of tensile strength (MPa)×elongation (%) more than or equal to 16,000 may be obtained.

Hereinafter, a method for manufacturing a high strength galvanized steel sheet having excellent surface qualities, plating adhesion, and formability, according to the present disclosure, will be described in detail.

The method for a high strength galvanized steel sheet having excellent surface qualities, plating adhesion, and formability, according to the present disclosure, may include: forming a steel slab comprising 0.1-0.3 wt % of C, 1-2.5 wt % of Si, 2.5-8 wt % of Mn, 0.001-0.5 wt % of sol. Al, 0.04 wt % or less of P, 0.015 wt % or less of S, 0.02 wt % or less of N (excluding 0 wt %), 0.1-0.7 wt % of Cr, 0.1 wt % or less of Mo, (48/14)*[N] to 0.1 wt % of Ti, 0.005-0.5 wt % of Ni, 0.01-0.07 wt % of Sb, 0.1 wt % or less of Nb, and 0.005 wt % or less of B, with the remainder being Fe and other inevitable impurities; reheating the steel slab at a temperature of 1100-1300° C.; ultimately hot rolling the re-heated steel slab at a $Ar_3$ transformation point or higher; coiling the hot rolled steel sheet at a temperature of 700° C. or lower; pickling and then cold rolling the coiled steel sheet; recrystallization annealing the cold rolled steel sheet at a dew point temperature of −60° C. to −20° C. and at a temperature of 750-950° C. for 5 to 120 seconds; cooling the annealed cold-rolled steel sheet to 200-600° C. at an average cooling rate of 2-150° C./s; reheating or cooling the cooled steel sheet to a temperature of (galvanizing bath temperature−20° C.) to (galvanizing bath temperature+100° C.); and plating the reheated or cooled steel sheet by dipping in a galvanizing bath maintained at a temperature of 450-500° C.

According to the present disclosure, the slab satisfying the above compositions may be reheated to a temperature within a range of 1100-1300° C. When the reheating temperature is less than 1100° C., a hot rolling load may be rapidly increased and, when the reheating temperature exceeds 1300° C., reheating costs may be raised and the amount of surface scale may be increased. Thus, the slab may be reheated to the temperature within the range of 1100-1300° C.

When a finish hot rolling temperature of the reheated slab is restricted to the $Ar_3$ transformation point (a temperature at which ferrite starts to appear when cooling austenite) or higher. This may be because a dual phase region of ferrite and austenite or a ferrite region is rolled at a temperature lower than the $Ar_3$ transformation point to form a duplex grain size structure and a wrong operation caused by variations of the hot rolling load occurs. Thus, the finish hot rolling may be performed at the $Ar_3$ transformation point or higher.

After the hot rolling, the steel sheet may be coiled at a temperature of 700° C. or lower. When the coiling temperature exceeds 700° C., an excessive amount of oxide film may be formed on the surface of the steel sheet to cause defects. Thus, the steel sheet may be coiled at the temperature of 700° C. or lower.

After pickling and cold rolling the coiled steel sheet, the cold rolled steel sheet may be subjected to recrystallization annealing at a dew point temperature of −60° C. to −20° C. and at a temperature of 750-950° C. for 5 to 120 seconds. When the dew point of an atmospheric gas within the annealing furnace is lower than −60° C., the surface diffusion rate of Si or Al in steel may be higher than that of Mn, so that Si and Al contents of a complex oxide including Si, Mn, or Al as a main component, formed on the surface of the steel sheet after annealing, may be greatly increased and, as the Si or Al content of the complex oxide on the surface is greater than the Mn content, platability may be deteriorated. Thus, even the steel sheet having the compositions of the present disclosure may be insufficient to ensure wettability with respect to Zn. When the dew point exceeds −20° C., a portion of Si, Mn, or Al may be oxidized in grain boundaries and in grains inside the base steel on the surface layer portion of the steel sheet to be present as an internal oxide and, in the case of pressing the steel sheet, the grain boundaries of the surface layer portion in which the internal oxide is present may be destroyed, so that the galvanized layer may be readily delaminated. Thus, the dew point of the atmospheric gas within the annealing furnace may preferably be −60° C. to −20° C. When the annealing temperature is 750° C. or higher, recrystallization may sufficiently occur and, when the annealing temperature exceeds 950° C., the lifespan of the annealing furnace may be reduced. Thus, the annealing temperature may preferably be 750-950° C. The annealing time of a minimum of 5 seconds may be required to obtain a uniform recrystallization structure, and the recrystallization annealing may preferably be performed within 120 seconds in terms of economy.

Here, the recrystallization annealing may preferably be performed within the annealing furnace with the $H_2$—$N_2$ gas atmosphere. The content of H in the atmospheric gas within the annealing furnace may preferably be 3-70 vol %. When the content of H is less than 3 vol %, the reduction of the Fe oxide present on the surface of the steel sheet may be insufficient and, even when the content of H exceeds 70%, the reduction effect of the Fe oxide on the surface of the steel sheet may be excellent. However, the content of H may preferably be restricted to 30% in view of economy.

Preferably, prior to the recrystallization annealing, plating the surface of the annealed cold-rolled steel sheet with at least one component selected from the group consisting of Fe, Ni, Co and Sn at a coating weight of 0.01-2 g/$m^2$ may additionally be performed. Such pre-plating may be very effective in controlling the dew point within the annealing furnace to a target range.

After the recrystallization annealing, cooling to 200-600° C. at an average cooling rate of 2-150° C./s may be performed to obtain a desired microstructure with a desired strength and elongation. Preferably, the cooling may be divided into a first cooling and a second cooling. A second cooling rate may be higher than a first cooling rate. More preferably, cooling to 400-740° C. may be performed in the first cooling, and cooling to 200-600° C. may be performed in the second cooling. As described above, the cooling may be divided into the first and second coolings and the first cooling rate may be lower than the second cooling rate. Thus, when the steel sheet is rapidly cooled at a high temperature, the steel sheet may be prevented from being slightly distorted.

The average cooling rate of a minimum of 2° C./s or higher may be required to prevent austenite from transforming into perlite in the dual phase region of ferrite and austenite by the recrystallization annealing. In contrast, when the average cooling rate exceeds 150° C./s, rapid cooling may cause an increase in the temperature difference in the width direction of the steel sheet, and thus the shape of the steel sheet may be poor.

The cooled steel sheet may be reheated or cooled to the temperature of (the temperature of the galvanizing bath−20° C.) to (the temperature of the galvanizing bath+100° C.) according to the temperature of the cooled steel sheet. When the temperature at which the cooled steel sheet is fed into the galvanizing bath is lower than (the temperature of the galvanizing bath−20° C.), wettability with respect to Zn may be deteriorated and, when the temperature at which the cooled steel sheet is fed into the galvanizing bath exceeds (the temperature of the galvanizing bath+100° C.), the temperature of the galvanizing bath may be locally increased, so that it may be difficult to manage the temperature of the galvanizing bath.

The reheated or cooled steel sheet may be plated by being dipped in the galvanizing bath maintained at a temperature of 450-500° C. It may be undesirable that, when the temperature of the galvanizing bath is lower than 440° C., viscosity of Zn may be increased to degrade drivability of a roll within the galvanizing bath and, when the temperature of the galvanizing bath exceeds 500° C., evaporation of Zn may be increased.

Here, the galvanizing bath may preferably include 0.2-1 wt % of Al, 0.5 wt % or less of at least one component selected from the group consisting of Fe, Ni, Cr, Mn, Mg, Si, P, S, Co, Sn, Bi, Sb and Cu, and the remainder being Zn and other inevitable impurities. While various steel types of steel sheets are plated by being dipped in the galvanizing bath, some components of the steel sheet may be dissolved in the galvanizing bath. When the various components are dissolved and present in the galvanizing bath in an amount of 0.5 wt % or less, they may not affect the galvanizing. Further, when the content of Al is less than 0.2 wt %, the formation of the Fe—Al alloy phase formed at the interface between the base steel and the galvanized layer may be inhibited and, when the content of Al exceeds 1 wt %, the content of Al within the galvanized layer may be increased to degrade weldability. Thus, the content of Al in the galvanizing bath may preferably be included in an amount of 0.2-1 wt %.

As described above, the microstructures of the cold-rolled steel sheet manufactured according to the manufacturing method of the present disclosure may include ferrite, bainite, martensite, and austenite. In particular, residual austenite may have an area fraction of 5-25%, and thus a tensile strength of 1,000 MPa or higher and a value of tensile strength (MPa)×elongation (%) more than or equal to 15,000 may be obtained.

[Mode for Invention]

Hereinafter, the present disclosure will be described in detail, according to examples. However, it should be noted that the following examples are merely provided to allow for a clearer understanding of the present disclosure, rather than to limit the scope thereof. The scope of the present disclosure is defined by the appended claims and items reasonably inferable therefrom.

Steel having the composition of Table 1 below was melted to manufacture a slab. The slab was maintained at a temperature of 1200° C. for 1 hour, finish rolled at 900° C., cooled to 650° C., maintained in a holding furnace at 650° C. for 1 hour, and then furnace cooled.

Whether hot rolling cracking occurred in a completely cooled hot-rolled steel sheet was observed by the naked eye, and the hot-rolled steel sheet was pickled with a 17 vol % HCl solution at 60° C. for 30 seconds to dissolve iron oxide on the surface of the steel sheet. Some specimens were further pickled for 20 seconds in the case that the pickling for 30 seconds was insufficient and, in the case that unpickled iron oxide on the surface was present even in the pickling for a total of 50 seconds, it was indicated by poor pickling.

The completely pickled steel sheet was cold rolled at a 55% reduction ratio, and impurities on the surface of the cold-rolled steel sheet were removed through preprocessing thereof. Then, the cold-rolled steel sheet was annealed under the heating and cooling conditions of Table 2 below, plated under the plating conditions of Table 2, adjusted to a coating weight of 60 g/$m^2$ using an air knife, and cooled, to manufacture a plated steel sheet.

As described above, the completely plated steel sheet was observed with the naked eye with regard to whether bare spots were present on the surface thereof and the extent of the bare spots to evaluate surface qualities. The results of the evaluation are illustrated in Table 2 below. Further, in order to evaluate plating adhesion of the steel sheet, an adhesive for an automotive structure was applied to the surface of the steel sheet and dried, the steel sheet was bent at an angle of 90°, and then whether the galvanized layer came away with the adhesive was confirmed. The results of the evaluation are illustrated in Table 2. The surface qualities illustrated in Table 2 were evaluated according to the following criteria: ○: the absence of bare spots; Δ: the presence of bare spots having a diameter of 2 mm or less; and X: the presence of bare spots having a diameter of 2 mm or greater. The plating adhesion was evaluated according to the following criteria: ○: the absence of plating delamination; and X: the observation of plating delamination.

Further, the plated steel sheet as a JIS #5 test piece was subjected to a tensile test to measure tensile strength and elongation of the steel sheet, and the measured tensile strength and elongation were converted into a value of tensile strength (MPa)×elongation (%). The results of the measurement are illustrated in Table 2.

Further, in order to observe the concentration of Sb in the surface layer portion of the steel sheet, the cross section thereof was processed by a focused ion beam (FIB) and, through the composition profile of 3-D atom probe topography (APT), the content of Sb within a depth of 0.1 μm in a depth direction of the base steel from the surface layer portion of the base steel was measured, the content of Sb after a depth of 0.5 μm in the depth direction of the base steel from the surface layer portion of the base steel was measured, and the ratio of the Sb content within the depth of 0.1 μm from the surface layer portion to that within the depth of 0.5 μm from the surface layer portion was measured to obtain the extent of the concentration.

TABLE 1

| Steel | Chemical Composition (wt %) | | | | | | | | | | | | | |
|---|---|---|---|---|---|---|---|---|---|---|---|---|---|---|
| type | C | Si | Mn | P | S | Sol. Al | Cr | Ti | B | Mo | N | Ni | Sb | Nb |
| A | 0.18 | 1.52 | 1.55 | 0.01 | 0.003 | 0.036 | 0.098 | 0.019 | — | 0.04 | 0.0036 | 0.008 | — | — |
| B | 0.16 | 1.55 | 2.7 | 0.0085 | 0.0027 | 0.5 | 0.4 | 0.019 | 0.002 | — | 0.0033 | 0.09 | — | — |
| C | 0.17 | 2.03 | 3.05 | 0.01 | 0.0026 | 0.01 | 0.5 | 0.02 | — | 0.05 | 0.0037 | 0.1 | 0.03 | 0.01 |
| D | 0.14 | 3.12 | 4.11 | 0.0095 | 0.003 | 0.5 | 0.2 | 0.008 | — | 0.02 | 0.0015 | 0.05 | — | — |
| E | 0.17 | 1.45 | 2.66 | 0.01 | 0.0029 | 0.031 | 0.6 | 0.02 | — | 0.06 | 0.004 | 0.05 | 0.05 | — |
| F | 0.15 | 1.66 | 2.75 | 0.008 | 0.003 | 0.016 | 0.5 | 0.019 | 0.0009 | 0.06 | 0.0036 | 0.01 | 0.01 | 0.01 |
| G | 0.22 | 1.59 | 2.58 | 0.01 | 0.0026 | 0.11 | 0.15 | 0.02 | 0.001 | — | 0.0037 | 0.2 | 0.02 | — |
| H | 0.2 | 0.32 | 1.94 | 0.0095 | 0.003 | 0.03 | 0.2 | 0.02 | — | — | 0.0045 | 0.2 | — | — |
| I | 0.2 | 1.35 | 2.96 | 0.01 | 0.0033 | 0.36 | 0.2 | — | 0.0009 | — | 0.0062 | 0.3 | — | 0.008 |
| J | 0.12 | 1.99 | 5.54 | 0.01 | 0.0022 | 0.21 | 0.4 | 0.025 | — | 0.02 | 0.0036 | 0.1 | 0.02 | — |
| K | 0.16 | 1.25 | 3.55 | 0.011 | 0.0025 | 0.007 | 0.2 | 0.009 | 0.002 | — | 0.0022 | 1 | 0.03 | — |
| L | 0.18 | 1.45 | 2.66 | 0.01 | 0.005 | 0.01 | 0.2 | 0.009 | — | 0.02 | 0.0023 | 0.01 | 0.002 | — |
| M | 0.18 | 1.65 | 12.5 | 0.015 | 0.0045 | 0.015 | 0.2 | 0.008 | 0.002 | — | 0.0025 | 0.2 | 0.02 | 0.005 |

TABLE 2

| Specimen No. | Occurrence of Hot Rolling Cracking | Picklability of Hot-Rolled Steel Sheet | TS(Mpa) | TS(Mpa) × E1 (%) | Surface Quality | Plating Adhesion | Extent of Concentration of Sb Within Depth of 0.1 μm in Depth Direction of Base Steel from Surface Layer Portion of Base Steel | Division |
|---|---|---|---|---|---|---|---|---|
| 1 | Absence | Good | >1000 | 17808 | X | X | — | Comparative Example |
| 2 | Absence | Good | 720 | 16886 | X | X | — | Comparative Example |
| 3 | Absence | Good | ≥1000 | 19332 | ○ | ○ | 3.4 | Inventive Example |
| 4 | Absence | Good | ≥1000 | 18781 | ○ | X | 3.17 | Comparative Example |
| 5 | Presence | Good | ≥1000 | 19417 | X | X | — | Comparative Example |
| 6 | Absence | Good | ≥1000 | 18963 | ○ | ○ | 4.18 | Inventive Example |
| 7 | Absence | Good | ≥1000 | 12808 | ○ | ○ | 4.5 | Comparative Example |
| 8 | Absence | Good | ≥1000 | 20116 | ○ | ○ | 2.9 | Inventive Example |
| 9 | Absence | Good | ≥1000 | 20050 | Δ | X | 1.78 | Comparative Example |
| 10 | Absence | Good | ≥1000 | 19800 | ○ | ○ | 3.6 | Inventive Example |
| 11 | Absence | Good | ≥1000 | 18800 | ○ | ○ | 3.51 | Inventive Example |
| 12 | Absence | Good | ≥1000 | 19030 | ○ | ○ | 4.92 | Inventive Example |
| 13 | Absence | Good | ≥1000 | 18760 | ○ | ○ | 3.63 | Inventive Example |
| 14 | Absence | Good | 847 | 14780 | Δ | ○ | — | Comparative Example |
| 15 | Presence | Good | ≥1000 | 16413 | X | X | — | Comparative Example |
| 16 | Absence | Good | ≥1000 | 18105 | ○ | ○ | 3.6 | Inventive Example |
| 17 | Absence | Good | ≥1000 | 16537 | ○ | X | 3.65 | Comparative Example |
| 18 | Absence | Good | ≥1000 | 18060 | X | X | 3.57 | Comparative Example |
| 19 | Absence | Good | ≥1000 | 13540 | ○ | ○ | 3.63 | Comparative Example |

TABLE 2-continued

| Specimen No. | Occurrence of Hot Rolling Cracking | Picklability of Hot-Rolled Steel Sheet | TS(Mpa) | TS(Mpa) × El (%) | Surface Quality | Plating Adhesion | Extent of Concentration of Sb Within Depth of 0.1 μm in Depth Direction of Base Steel from Surface Layer Portion of Base Steel | Division |
|---|---|---|---|---|---|---|---|---|
| 20 | Absence | Good | ≥1000 | 18163 | ○ | X | 3.52 | Comparative Example |
| 21 | Absence | Poor | ≥1000 | 17928 | X | ○ | 2.89 | Comparative Example |
| 22 | Absence | Good | ≥1000 | 19123 | X | X | 1.05 | Comparative Example |
| 23 | Absence | Good | ≥1000 | 16800 | Δ | X | 2.35 | Comparative Example |

TABLE 3

| Specimen No. | Steel Type | Annealing Temperature (° C.) | Holding Time (sec) | Atmospheric Gas in Annealing Furnace | Dew Point in Annealing Furnace (° C.) | First Cooling Temperature (° C.) | First Cooling Rate (° C./sec) | Second Cooling Temperature (° C.) | Second cooling rate (° C./sec) | Feed Temperature of Steel Sheet into Galvanizing Bath (° C.) | Temperature of Galvanizing Bath (° C.) | Al Concentration of Galvanizing Bath (wt %) | Division |
|---|---|---|---|---|---|---|---|---|---|---|---|---|---|
| 1 | B | 820 | 45 | 5%$H_2$—$N_2$ | −45 | 670 | 2 | 300 | 18 | 490 | 456 | 0.18 | Comparative Example |
| 2 | A | 830 | 60 | 10%$H_2$—$N_2$ | −45 | 660 | 4 | 450 | 10 | 485 | 456 | 0.21 | Comparative Example |
| 3 | C | 820 | 60 | 5%$H_2$—$N_2$ | −55 | 680 | 2.1 | 290 | 20 | 500 | 457 | 0.22 | Inventive Example |
| 4 | C | 850 | 60 | 5%$H_2$—$N_2$ | −10 | 680 | 3.2 | 300 | 19 | 500 | 457 | 0.22 | Comparative Example |
| 5 | D | 850 | 60 | 3%$H_2$—$N_2$ | −39 | 660 | 3.5 | 400 | 13 | 479 | 455 | 0.2 | Comparative Example |
| 6 | E | 800 | 80 | 5%$H_2$—$N_2$ | −42 | 650 | 2.2 | 240 | 21 | 510 | 455 | 0.21 | Inventive Example |
| 7 | E | 700 | 56 | 5%$H_2$—$N_2$ | −56 | 550 | 2.3 | 220 | 17 | 490 | 455 | 0.24 | Comparative Example |
| 8 | F | 830 | 80 | 5%$H_2$—$N_2$ | −42 | 670 | 3.8 | 230 | 45 | 485 | 455 | 0.16 | Inventive Example |
| 9 | F | 880 | 42 | 5%$H_2$—$N_2$ | −75 | 670 | 3.7 | 280 | 26 | 510 | 456 | 0.2 | Comparative Example |
| 10 | G | 860 | 59 | 5%$H_2$—$N_2$ | −55 | 670 | 3.3 | 250 | 25 | 500 | 456 | 0.21 | Inventive Example |
| 11 | G | 780 | 90 | 5%$H_2$—$N_2$ | −39 | 700 | 2.7 | 220 | 48 | 475 | 456 | 0.23 | Inventive Example |
| 12 | G | 860 | 34 | 5%$H_2$—$N_2$ | −56 | 660 | 4.3 | 350 | 14 | 500 | 480 | 0.23 | Inventive Example |
| 13 | G | 800 | 55 | 5%$H_2$—$N_2$ | −48 | 400 | 36 | — | — | 480 | 460 | 0.19 | Inventive Example |
| 14 | H | 820 | 55 | 5%$H_2$—$N_2$ | −72 | 660 | 2.7 | 250 | 17 | 500 | 456 | 0.22 | Comparative Example |
| 15 | I | 840 | 60 | 5%$H_2$—$N_2$ | −45 | 660 | 2.9 | 300 | 14 | 500 | 456 | 0.22 | Comparative Example |
| 16 | J | 820 | 60 | 5%$H_2$—$N_2$ | −50 | 690 | 2.1 | 350 | 15 | 500 | 456 | 0.22 | Inventive Example |
| 17 | J | 850 | 50 | 5%$H_2$—$N_2$ | +5 | 660 | 4.5 | 300 | 22 | 480 | 456 | 0.21 | Comparative Example |
| 18 | J | 850 | 50 | 5%$H_2$—$N_2$ | −44 | 660 | 4.5 | 300 | 22 | 420 | 456 | 0.23 | Comparative Example |
| 19 | J | 780 | 50 | 5%$H_2$—$N_2$ | −42 | 700 | 0.2 | 500 | 1.2 | 480 | 456 | 0.22 | Comparative Example |

TABLE 3-continued

| Specimen No. | Steel Type | Annealing Temperature (° C.) | Holding Time (sec) | Atmospheric Gas in Annealing Furnace | Dew Point in Annealing Furnace (° C.) | First Cooling Temperature (° C.) | First Cooling Rate (° C./sec) | Second Cooling Temperature (° C.) | Second cooling rate (° C./sec) | Feed Temperature of Steel Sheet into Galvanizing Bath (° C.) | Temperature of Galvanizing Bath (° C.) | Al Concentration of Galvanizing Bath (wt %) | Division |
|---|---|---|---|---|---|---|---|---|---|---|---|---|---|
| 20 | J | 860 | 59 | 5%$H_2$—$N_2$ | −55 | 670 | 3.3 | 250 | 25 | 500 | 456 | 0.1 | Comparative Example |
| 21 | K | 820 | 55 | 5%$H_2$—$N_2$ | −42 | 660 | 2.7 | 250 | 17 | 500 | 456 | 0.18 | Comparative Example |
| 22 | L | 860 | 34 | 5%$H_2$—$N_2$ | −56 | 660 | 4.3 | 350 | 14 | 500 | 480 | 0.21 | Comparative Example |
| 23 | M | 820 | 53 | 5%$H_2$—$N_2$ | −42 | 660 | 2.7 | 250 | 17 | 500 | 456 | 0.21 | Comparative Example |

As illustrated in Tables 1 through 3, specimens 3, 6, 8, 10 through 13, and 15, Inventive Examples of the present disclosure, were galvanized steel sheets manufactured according to the manufacturing method of the present disclosure using types of steels having the compositions defined in the present disclosure, had no hot rolling cracking, and had good picklability. Further, the tensile strength of the manufactured steel sheets was 1,000 MPa or higher and a value of tensile strength (TS)×elongation (EL) was high, for example, 15,000 or higher, so that material properties were excellent. Further, the extent of the concentration of Sb within the depth of 0.1 μm in the depth direction of the base steel from the surface layer portion of the base steel was high, for example, 1.5 or higher, to inhibit the surface concentration of Si or Mn, so that bare spots were not generated, and a Fe—Al alloy phase was densely formed at an interface between a galvanized layer and the base steel, so that plating adhesion was excellent.

In the case of Comparative Example 1, the manufacturing method satisfied the range of the present disclosure, but Sb was not added to the steel. In the annealing process, the surface diffusion of oxidative components such as Si, Mn, or Al was not inhibited, so that a thick surface oxide caused poor wettability with respect to Zn, and thus surface qualities were poor. The surface oxide also caused a Fe—Al alloy phase to not be densely formed at an interface between a galvanized layer and a base steel, and thus the degree of adhesion between the galvanized layer and the base steel was poor.

In the case of Comparative Example 2, the contents of Mn and Cr of steel components were lower than the range defined in the present disclosure, so that tensile strength was lower than the range defined in the present disclosure, and Sb was not added to steel. Accordingly, a thick surface oxide caused poor wettability with respect to Zn, and thus surface qualities were poor. The surface oxide also caused a Fe—Al alloy phase to not be densely formed at an interface between a galvanized layer and a base steel, and thus plating delamination between the galvanized layer and the base steel occurred.

In the case of Comparative Examples 4 and 17, steel components satisfied the range defined in the present disclosure, but a dew point within an annealing furnace was higher than the range defined in the present disclosure. Plating surface qualities and the adhesion between a galvanized layer and a base steel were excellent by the effect of inhibiting Si, Mn, or Al from diffusing into the surface of the galvanized layer by the addition of Sb. However, Si, Mn, or Al was oxidized in grain boundaries and in grains inside the base steel of a surface layer portion of a steel sheet to be present as an internal oxide. When the steel sheet was bent at 90° in a plating adhesion evaluation process, the grain boundaries of the surface layer portion in which the internal oxide was present were destroyed, so that the galvanized layer was delaminated, resulting in poor plating adhesion.

In the case of Comparative Example 5, the amount of added Si of steel components exceeded the range of the present disclosure and Sb was not added to steel. Cracking occurred in edges of a hot-rolled steel sheet due to an excessive amount of Si, a thick surface oxide formed by no addition of Sb caused poor wettability with respect to Zn, and thus surface qualities were poor. The surface oxide also caused a Fe—Al alloy phase to not be densely formed at an interface between a galvanized layer and a base steel, and thus plating delamination occurred.

In the case of Comparative Example 7, steel components satisfied the range of the present disclosure, but an annealing temperature was lower than the range defined in the present disclosure. A sufficient degree of recrystallization did not occur, so that strength was high but elongation was low, and thus a value of TS×El was lower than the range defined in the present disclosure. However, the amount of added Sb and other manufacturing conditions satisfied the present disclosure, so that the extent of the concentration of Sb within a depth of 0.1 μm in a depth direction of a base steel from a surface layer portion of the base steel satisfied the range defined in the present disclosure. Thus, the formation of a surface oxide was inhibited so that surface qualities and plating adhesion were excellent.

In the case of Comparative Example 9, the contents of steel components were within the range of the present disclosure, material properties were excellent, but a dew point within an annealing furnace was lower than the range defined in the present disclosure. Because the contents of Si and Al of a complex oxide including Si, Mn, or Al as a main component, formed on the surface of a steel sheet in an annealing process, were greatly increased, compared to the content of Mn, even the steel sheet having the compositions of the present disclosure was insufficient to ensure wettability with respect to Zn, so that bare spots having a diameter of 2 mm or less were present. A Fe—Al alloy phase was not densely formed at an interface between a galvanized layer and a base steel, and thus plating delamination occurred.

In the case of Comparative Example 14, the contents of Si and Mn in steel were lower than the range defined in the present disclosure and Sb was not added to steel. Tensile strength was low, for example, 847 MPa, and a value of TS×El was lower than the range defined in the present disclosure. However, since the contents of Si and Mn were low, Sb was not added to steel and, even when a dew point within an annealing furnace was outside of the range of the present disclosure, a surface oxide such as Si, Mn, or Al was formed in a relatively small amount, so that bare spots having a diameter of 2 mm or less were present. However, a Fe—Al alloy phase was relatively densely formed at an interface between a galvanized layer and a base steel, and thus plating adhesion was excellent.

In the case of Comparative Example 15, Ti and Sb were not added to steel. Hot rolling cracking caused by AlN formation occurred and, due to no addition of Sb, surface qualities and plating adhesion were poor.

In the case of Comparative Example 18, steel components satisfied the range defined in the present disclosure, other manufacturing conditions were within the range of the present disclosure, material properties were excellent, but a temperature at which a steel sheet was fed into a galvanizing bath was lower than the range defined in the present disclosure. Wettability between the steel sheet and Zn was deteriorated so that plating surface qualities were poor, and a Fe—Al alloy phase was not densely formed at an interface between a galvanized layer and a base steel so that plating adhesion was poor.

In the case of Comparative Example 19, steel components satisfied the range defined in the present disclosure. However, a cooling rate after annealing was lower than the range defined in the present disclosure, so that a portion of austenite transformed into pearlite during cooling, which caused a reduction in ductility. Thus, a value of TS×El was lower than the range defined in the present disclosure.

In the case of Comparative Example 20, steel components satisfied the range defined in the present disclosure, other manufacturing conditions were within the range of the present disclosure, material properties were excellent, but the Al content of a galvanizing bath was lower than the range defined in the present disclosure. After galvanizing, an insufficient amount of Fe—Al alloy phase was formed at an interface between a galvanized layer and a base steel so that plating adhesion was poor.

In the case of Comparative Example 21, the Ni content of steel exceeded the range of the present disclosure. Due to a high content of Ni, picklability of a hot-rolled steel sheet was deteriorated so that a non-pickled oxide was present in a portion of the surface of the hot-rolled steel sheet after pickling. Then, after cold rolling and galvanizing, the non-pickled oxide remained in the portion of the steel sheet. That is, bare spots having a diameter of 2 mm or less were present in the portion, and thus surface qualities were poor. However, the amount of added Sb, and other steel components and manufacturing methods were within the range defined in the present disclosure, material properties satisfied the present disclosure, and the extent of the concentration of Sb within a depth of 0.1 μm in a depth direction of a base steel from a surface layer portion of the base steel satisfied the range of the present disclosure. Thus, the resulting effect of inhibiting a surface oxide allowed a Fe—Al alloy phase to be densely formed at an interface between a galvanized layer and the base steel, so that plating adhesion was excellent.

In the case of Comparative Example 22, the content of Sb in steel components was lower than the range defined in the present disclosure. The extent of the concentration of Sb within a depth of 0.1 μm in a depth direction of a base steel from a surface layer portion of the base steel was lower than the range defined in the present disclosure, so that the effect of reducing a surface oxide was reduced. Thus, the effect of increasing wettability with respect to Zn was poor, and an insufficient amount of Fe—Al alloy phase was formed at an interface between a galvanized layer and the base steel, so that plating adhesion was poor.

In the case of Comparative Example 23, the content of Mn in steel components exceeded the range defined in the present disclosure. Even when other steel components and manufacturing conditions satisfied the range of the present disclosure, a thick oxide was formed on the surface of steel after annealing, so that plating adhesion after galvanizing was poor and surface wettability was slightly deteriorated. Thus, bare spots having a diameter of 2 mm or less were present.

The invention claimed is:

1. A high strength galvanized steel sheet having excellent surface qualities, plating adhesion, and formability, wherein a galvanized layer is formed on a cold-rolled steel sheet comprising 0.1-0.3 wt % of C, 1-2.5 wt % of Si, 3.05-8 wt % of Mn, 0.001-0.5 wt % of sol. Al, 0.04 wt % or less of P, 0.015 wt % or less of S, 0.02 wt % or less of N (excluding 0 wt %), 0.1-0.7 wt % of Cr, 0.1 wt % or less of Mo, (48/14)*[N] to 0.1 wt % of Ti, 0.005-0.5 wt % of Ni, 0.01-0.07 wt % of Sb, 0.1 wt % or less of Nb, and 0.005 wt % or less of B, with the remainder being Fe and other inevitable impurities, and the average content of Sb in the galvanized layer from the surface of the cold-rolled steel sheet to a depth of 0.1 μm is at least 1.5 times that at a depth of 0.5 μm or more from the surface of the cold-rolled steel sheet, and wherein the steel sheet has a pre-plating layer containing at least one component selected from the group consisting of Fe, Ni, Co and Sn with a coating weight of 0.01-2 $g/m^2$ between the steel sheet and the galvanized layer.

2. The high strength galvanized steel sheet of claim 1, wherein a microstructure of the cold-rolled steel sheet comprises residual austenite in an area fraction of 5-25%.

3. The high strength galvanized steel sheet of claim 1, wherein the cold-rolled steel sheet has a tensile strength of 1,000 MPa or higher, and a value of tensile strength (MPa)× elongation (%) is 15,000 or higher.

4. A method for a high strength galvanized steel sheet having excellent surface qualities, plating adhesion, and formability, the method comprising:

forming a steel slab comprising 0.1-0.3 wt % of C, 1-2.5 wt % of Si, 3.05-8 wt % of Mn, 0.001-0.5 wt % of sol. Al, 0.04 wt % or less of P, 0.015 wt % or less of S, 0.02 wt % or less of N (excluding 0 wt %), 0.1-0.7 wt % of Cr, 0.1 wt % or less of Mo, (48/14)*[N] to 0.1 w t% of Ti, 0.005-0.5 wt % of Ni, 0.01-0.07 wt % of Sb, 0.1 wt % or less of Nb, and 0.005 wt % or less of B, with the remainder being Fe and other inevitable impurities;

reheating the steel slab at a temperature of 1100-1300° C.;

ultimately hot rolling the re-heated steel slab at a $Ar_3$ transformation point or higher;

coiling the hot rolled steel sheet at a temperature of 700° C. or lower;

pickling and then cold rolling the coiled steel sheet;

recrystallization annealing the cold rolled steel sheet at a dew point temperature of −60° C. to 39° C. and at a temperature of 750-950° C. for 5 to 120 seconds;

cooling the annealed cold-rolled steel sheet to 200-600° C. at an average cooling rate of 2-150° C/s;

reheating or cooling the cooled steel sheet to a temperature of (galvanizing bath temperature-20° C.) to (galvanizing bath temperature +100° C.);

plating the reheated or cooled steel sheet by dipping in a galvanizing bath maintained at a temperature of 450-500° C.; and further comprising, prior to the annealing, plating a surface of the annealed cold-rolled steel sheet containing at least one component selected from the group consisting of Fe, Ni, Co and Sn with a coating weight of 0.01-2 $g/m^2$;

wherein the cooling is divided into a first cooling and a second cooling, cooling to 400-740° C. is performed in the first cooling, and cooling to 200-600° C. is performed in the second cooling, and wherein the second cooling rate is higher than the first cooling rate.

5. The method of claim 4, wherein the recrystallization annealing is performed in a $H_2$—$N_2$ gas atmosphere.

6. The method of claim 4, wherein the galvanizing bath comprises: 0.2-1 wt % of Al; and 0.5 wt % or less of at least one component selected from the group consisting of Fe, Ni, Cr, Mn, Mg, Si, P, S, Co, Sn, Bi, Sb and Cu, with the remainder being Zn and other inevitable impurities.

* * * * *